US012172202B2

(12) United States Patent
Sasaki et al.

(10) Patent No.: US 12,172,202 B2
(45) Date of Patent: Dec. 24, 2024

(54) SKEW ROLLING APPARATUS, METHOD FOR MANUFACTURING SEAMLESS PIPE SHELL, AND METHOD FOR MANUFACTURING SEAMLESS STEEL PIPE

(71) Applicant: JFE STEEL CORPORATION, Tokyo (JP)

(72) Inventors: Shunsuke Sasaki, Tokyo (JP); Tatsuro Katsumura, Tokyo (JP); Hideo Kijima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 281 days.

(21) Appl. No.: 17/921,283

(22) PCT Filed: Mar. 17, 2021

(86) PCT No.: PCT/JP2021/010935
§ 371 (c)(1),
(2) Date: Oct. 25, 2022

(87) PCT Pub. No.: WO2021/220653
PCT Pub. Date: Nov. 4, 2021

(65) Prior Publication Data

US 2023/0182185 A1 Jun. 15, 2023

(30) Foreign Application Priority Data

Apr. 30, 2020 (JP) ..... 2020-080086

(51) Int. Cl.
*B21B 19/04* (2006.01)

(52) U.S. Cl.
CPC ..... *B21B 19/04* (2013.01)

(58) Field of Classification Search
CPC ..... B21B 19/02; B21B 19/04
(Continued)

(56) References Cited

U.S. PATENT DOCUMENTS 361,961 A * 4/1887 Mannesmann ..... B21B 19/04 72/97
401,144 A * 4/1889 Flagler ..... B21B 19/04 72/97

(Continued)

FOREIGN PATENT DOCUMENTS

EP 2002904 A1 12/2008
GB 2089702 A * 6/1982 ..... B21B 23/00

(Continued)

OTHER PUBLICATIONS

Jul. 18, 2023 Extended European Search Report issued in European Patent Application No. 21796041.8.

(Continued)

*Primary Examiner* — Christopher L Templeton
*Assistant Examiner* — P Derek Pressley
(74) *Attorney, Agent, or Firm* — Oliff PLC

(57) ABSTRACT

A skew rolling apparatus with which shape defects in non-steady-state portions at the front and back ends of a seamless pipe shell can be prevented. The skew rolling apparatus includes a skew pierce rolling mill configured to pierce roll a steel material into a seamless pipe shell, and a skew outside-diameter mill following the skew piercing mill in a pass direction of the seamless pipe shell in the skew rolling apparatus. The skew rolling apparatus satisfies specified formulae.

20 Claims, 5 Drawing Sheets

(58) Field of Classification Search
USPC ..... 72/95, 96, 97, 98
See application file for complete search history.

(56) References Cited

U.S. PATENT DOCUMENTS

| | | | | |
|---|---|---|---|---|
| 2,274,579 | A * | 2/1942 | Bannister | B21B 19/02 72/97 |
| 2011/0023570 | A1 | 2/2011 | Saitou | |
| 2015/0121982 | A1* | 5/2015 | Yamane | B21B 25/02 72/462 |
| 2016/0059285 | A1* | 3/2016 | Cernuschi | B21B 19/04 72/97 |

FOREIGN PATENT DOCUMENTS

| | | | | |
|---|---|---|---|---|
| JP | 55106612 | A * | 8/1980 | B21B 37/78 |
| JP | 56095409 | A * | 8/1981 | |
| JP | 2002-331301 | A | 11/2002 | |
| JP | 2009-241075 | A | 10/2009 | |
| JP | 2016-30275 | A | 3/2016 | |

OTHER PUBLICATIONS

May 25, 2021 International Search Report issued in International Application No. PCT/JP2021/010935.

* cited by examiner

[FIG. 1]
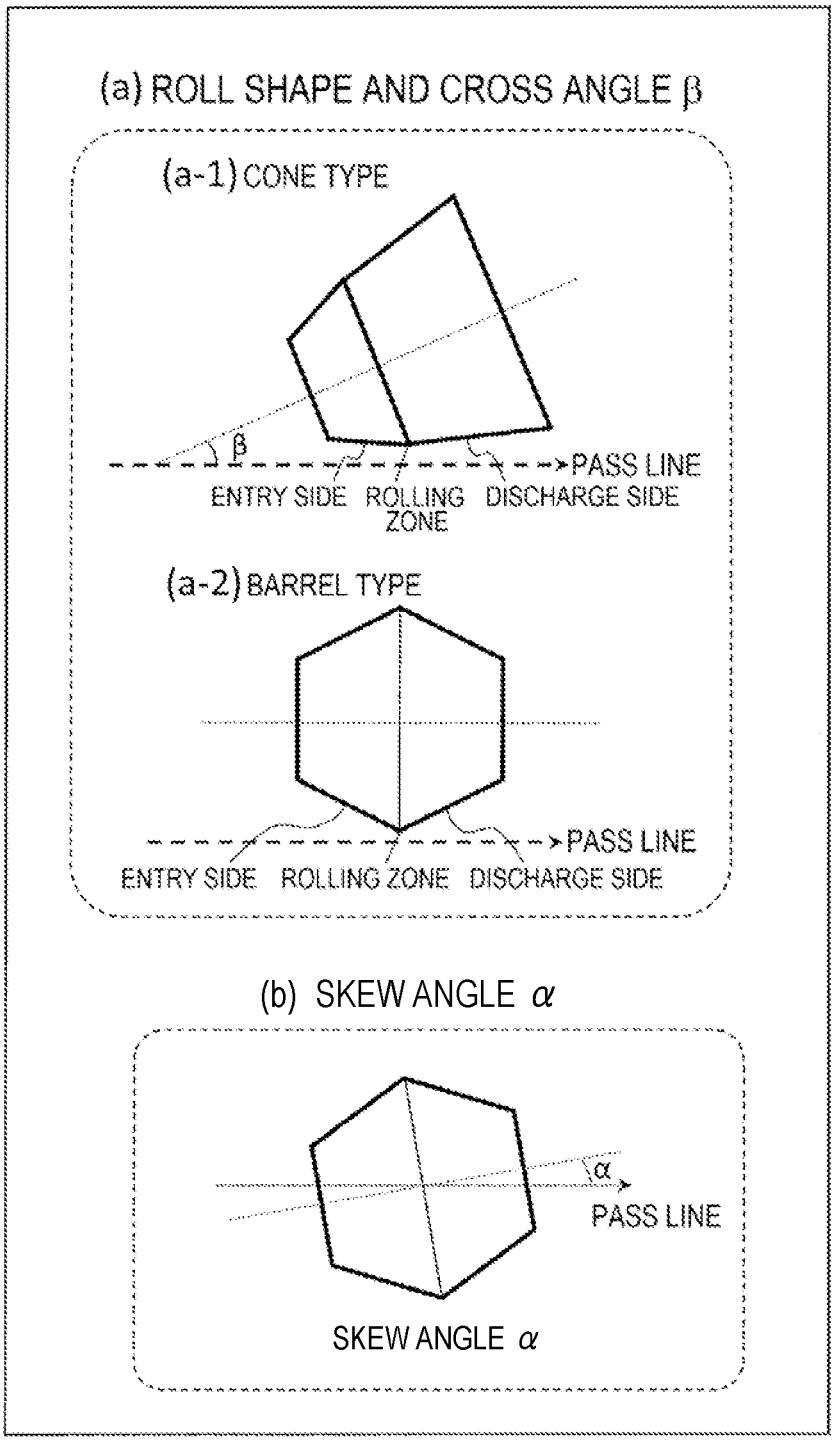

[FIG. 2]
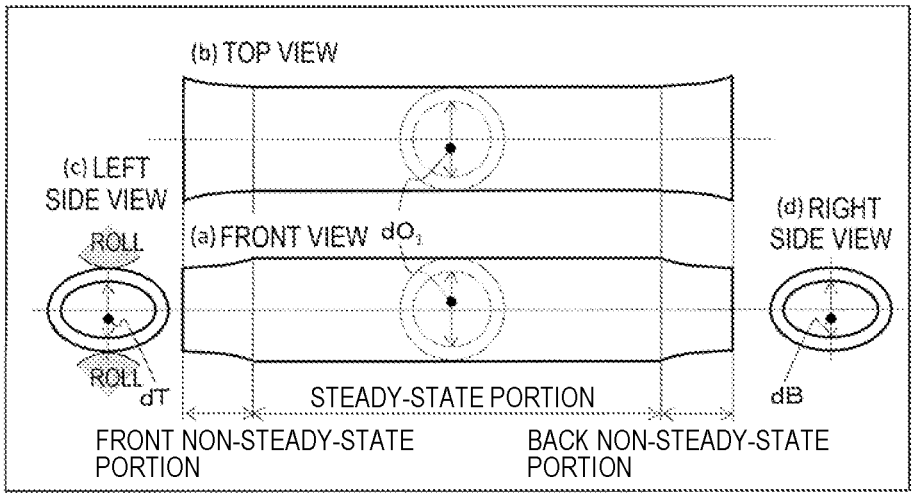
[FIG. 3]
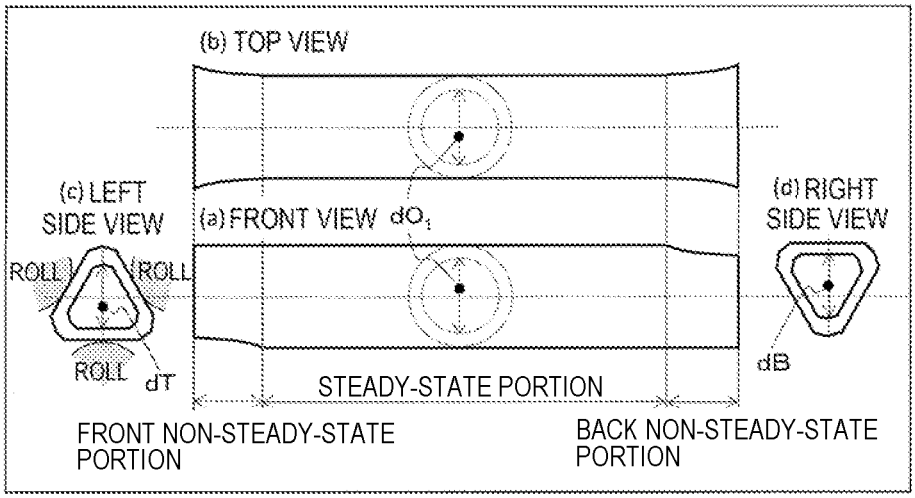

[FIG. 4]
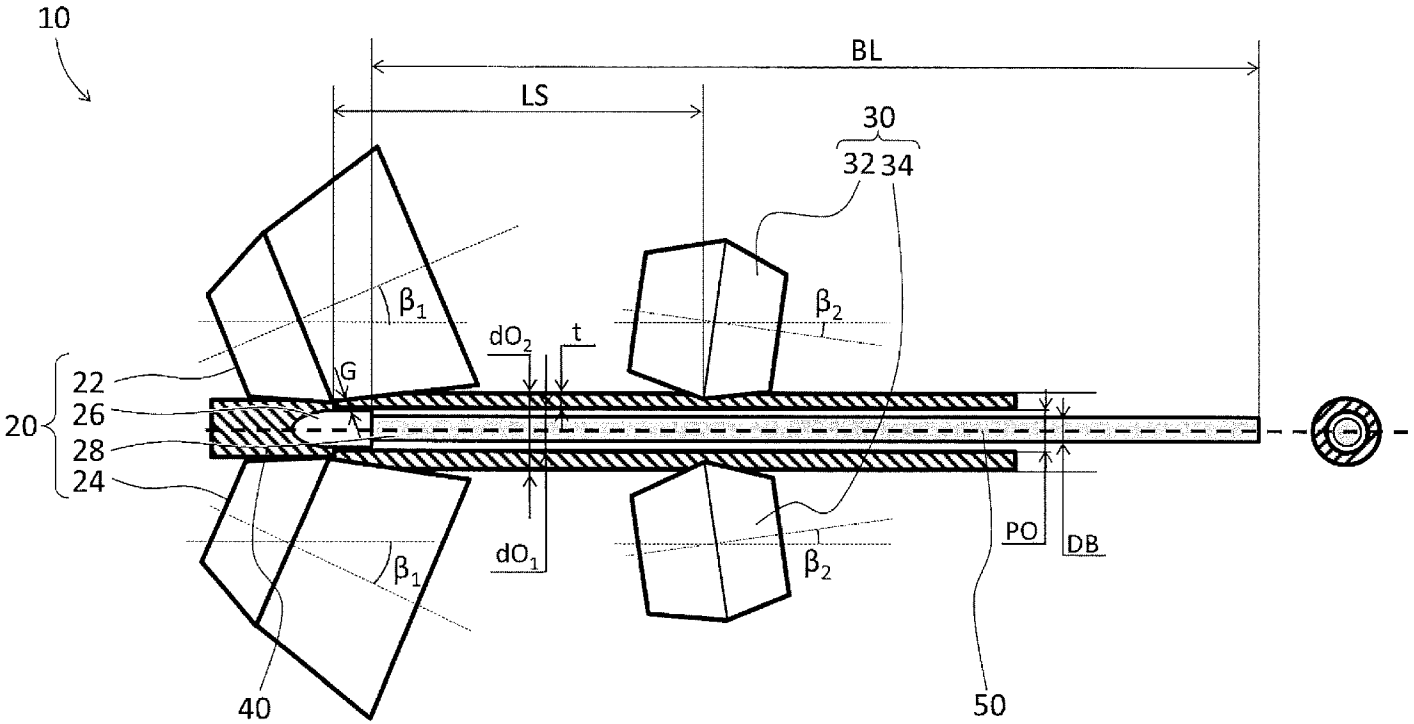

[FIG. 5]
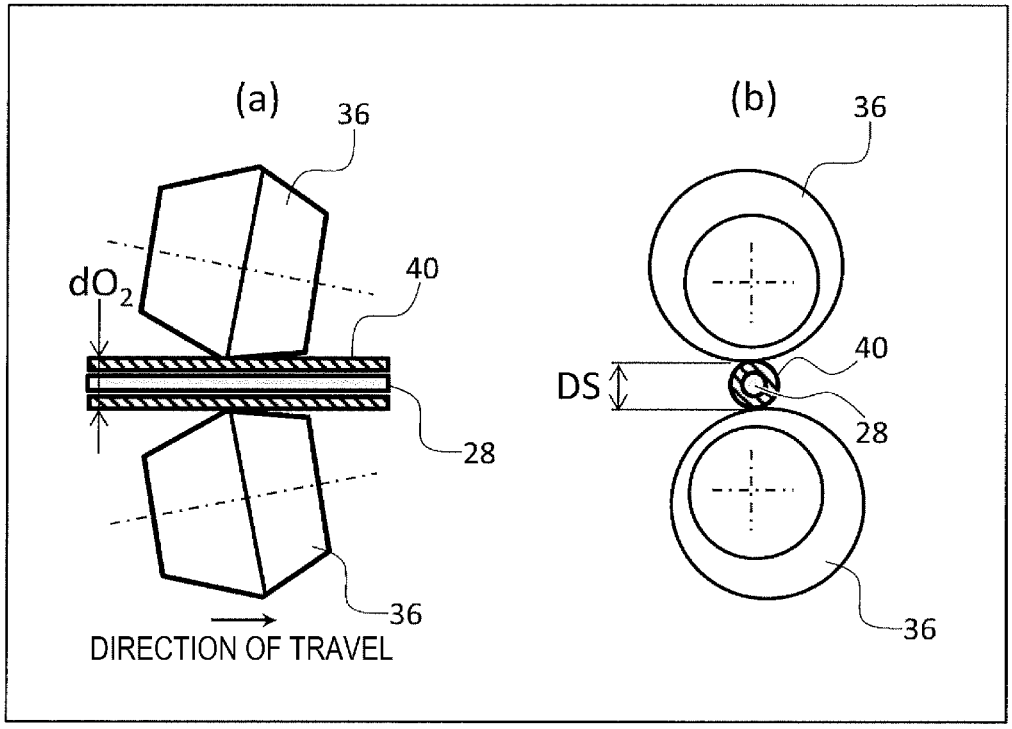

[FIG. 6]
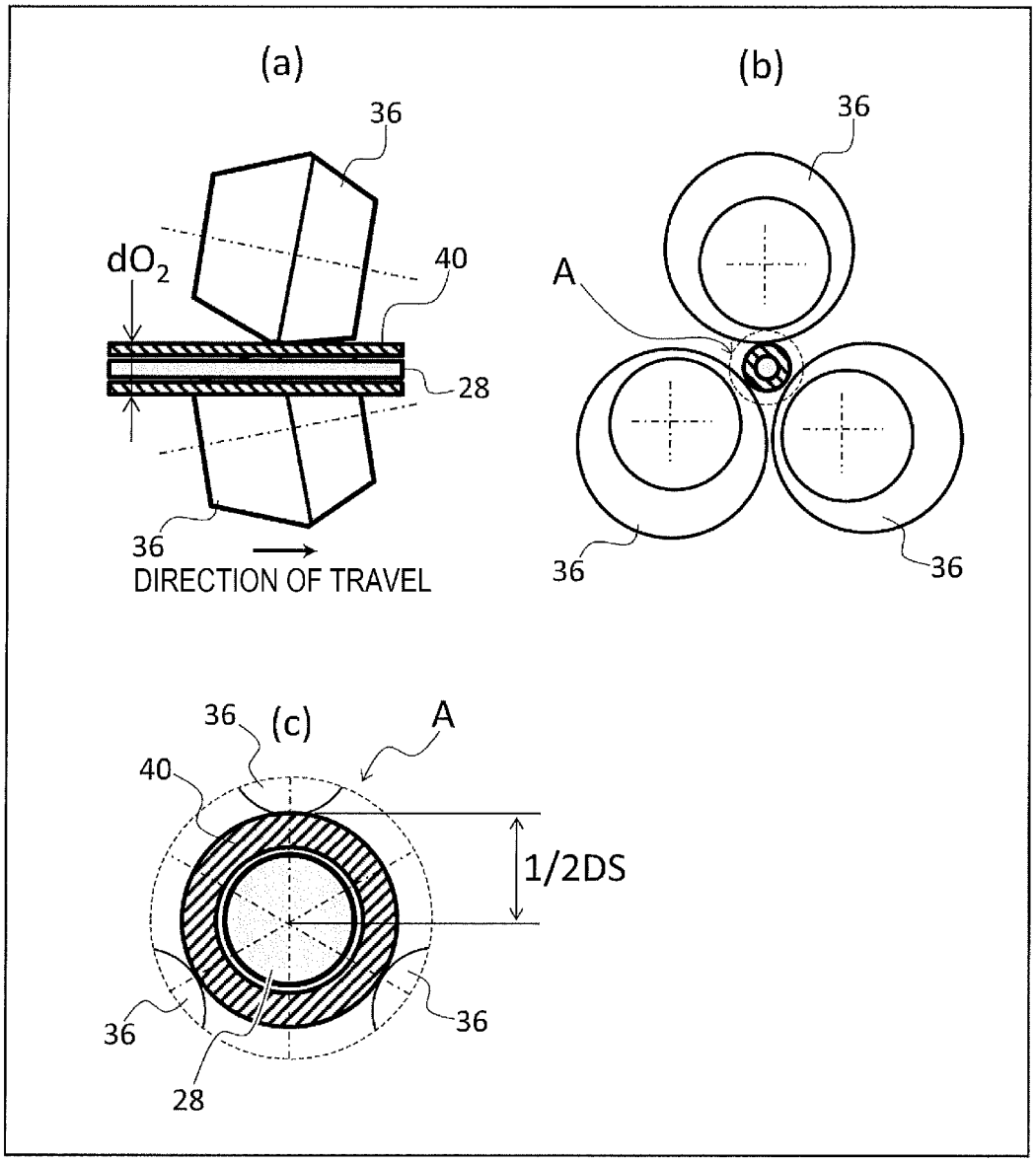

SKEW ROLLING APPARATUS, METHOD FOR MANUFACTURING SEAMLESS PIPE SHELL, AND METHOD FOR MANUFACTURING SEAMLESS STEEL PIPE

TECHNICAL FIELD

This application relates to a skew rolling apparatus for manufacture of seamless pipe shells, and to a method for manufacturing a seamless pipe shell, and a method for manufacturing a seamless steel pipe.

BACKGROUND

A skew rolling mill is an apparatus used to pierce a solid round billet to obtain a hollow seamless pipe shell. In a skew rolling mill, barrel- or cone-shaped rolling rolls are positioned askew at an angle to the pass line, and are rotated to draw in a solid round billet between the rolls, where the billet is pierce-rolled to form a seamless pipe shell with a plug disposed between the rolls.

A skew rolling mill is used worldwide because it allows efficient production of seamless pipe shells of various sizes only by varying the gap between the rolling rolls and using plugs of different shapes. In fact, various forms of skew rolling mills and a variety of rolling methods have been put to practical use. Some skew rolling mills have actually been used to improve dimensional accuracy of wall thickness and outside diameter while others are used for pierce rolling of difficult-to-process materials such as stainless steel.

For example, PTL 1 discloses a method whereby the back of a billet being rolled at the front is pushed to improve biting of the billet with rolls at the leading end of the billet, and to enable a plug to be more freely positioned. PTL 1 states that, by pushing the back of a billet being rolled at the front, trouble due to biting failure can be prevented to provide a seamless pipe shell that is free from inner surface defects, even when materials that are not easily workable by pierce rolling are used.

CITATION LIST

Patent Literature

PTL 1: JP-A-2016-30275

SUMMARY

Technical Problem

Pierce rolling with a skew rolling mill can produce the following effects by optimizing the structure and the roll shape of a skew rolling mill, the mechanism used to push a workpiece at the entry side, and rolling conditions.

1. Improved dimensional accuracy of the seamless steel pipe produced.
2. Pierce rolling of difficult-to-process materials (e.g., hard alloy steels) into a thin-walled pipe having reduced inner and outer surface defects.

However, such pierce rolling is primarily intended for the steady-state portion of a seamless steel pipe, and is not fully investigated with regard to the shape of non-steady-state portions that occur at the front and back ends of a seamless pipe shell formed by pierce rolling.

The primary interest of previous investigations is directed to shaping the steady-state portion because the non-steady-state portions at the front and back ends of a seamless pipe shell are cut off and discarded to make the final product. In pierce rolling using a skew rolling mill, it is in principle not possible to completely eliminate the non-steady-state portions at the front and back ends of a seamless pipe shell, and the seamless pipe shell produced always has non-steady-state portions. The presence of non-steady-state portions does not directly affect the product yield. However, the inventors found that shape control of non-steady-state portions is extremely important for improved productivity in hot rolling performed after the pierce rolling performed with a skew rolling mill. The following discusses the hot rolling performed after the pierce rolling performed with a skew rolling mill, and problems caused by formation of non-steady-state portions at the front and back ends of a seamless pipe shell formed by pierce rolling.

The wall thickness of a seamless pipe shell after pierce rolling with a skew rolling mill is not thin enough, and the outside diameter and the inner and outer surface quality of the seamless pipe shell are not satisfactory in an as-processed form. In order to set the wall thickness, outside diameter, and rolled surface quality, the pierce rolling is followed by hot rolling with various types of steel pipe rolling mills to form a seamless steel pipe. For example, a mandrel mill or a plug mill is used for the process that reduces the wall thickness and stretches the seamless pipe shell. An elongator or an assel mill is also used that reduces the wall thickness and expands the seamless pipe shell using the same skew rolling mill used for pierce rolling. Other processes include reeler rolling that sets the inner and outer surface quality while slightly reducing the wall thickness. These rolling mills are selected or combined according to the size of the seamless steel pipe to be produced, or the type of the steel used. For production of a seamless steel pipe, pierce rolling must be followed by a hot rolling process. In hot rolling, the seamless pipe shell from pierce rolling is rolled from inside throughout the process. For this purpose, an internal tool with a shape selected according to the rolling mill is inserted into the seamless pipe shell. That is, pierce rolling must be followed by a hot rolling process to make a shape of the seamless pipe shell into a product, and the hot rolling process is always accompanied by insertion of an internal tool into the seamless pipe shell.

The internal tool inserted into the seamless pipe shell is used to roll the seamless pipe shell from inside. To this end, the internal tool is typically configured to have a diameter about the same or slightly smaller than the inside diameter of the seamless pipe shell receiving the internal tool. When the front and back ends of a seamless pipe shell after pierce rolling have non-steady-state portions that are, for example, ellipsoidal or greatly different from a true circle, the minor axis of the inside diameter is shorter than the diameter of the internal tool. This causes insertion failure of the internal tool, and stops the production line.

Aside from insertion failure of internal tool before hot rolling, a shape defect in non-steady-state portions at the front and back ends of a seamless pipe shell also causes trouble during hot rolling. For example, when the front and back ends of a seamless pipe shell have non-steady-state portions that are ellipsoidal or greatly different from a true circle, or when the minor axis or major axis of non-steady-state portions is greatly different from the diameter of the steady portion, the non-steady portions at the front and back ends of a seamless pipe shell protrude from the rolling rolls or guides during hot rolling, and the hot rolling process stops. Shape defects in the front non-steady-state portion causes the seamless pipe shell to whirl as a result of a failure to evenly contact the rolling rolls upon being bitten by the rolling rolls of a hot rolling mill. Such whirling of a seamless pipe shell not only halts hot rolling but lowers the accuracy of the wall thickness and outside diameter of the product of seamless steel pipe. Once the hot rolling stops, the steel pipe must be kept in the rolling mill to allow time to cool down, and cut and removed for process recovery. That is, suspension of hot rolling involves substantial lengths of time for recovery, and this greatly decreases the productivity of seamless steel pipe production.

In pierce rolling, when the outside diameter of the non-steady portion at the back end of a seamless pipe shell becomes smaller than the roll gap and the guide gap at the discharge side as a result of shape defects occurring in the back non-steady-state portion, the force that advances the seamless pipe shell after pierce rolling decreases as a result of reduced contact surface pressure of the back non-steady-state portion against the rolling rolls and guide surface. In this case, the seamless pipe shell, finished with pierce rolling, cannot be discharged from the discharge side, and fails to carry itself into the hot rolling process after the pierce rolling performed with a skew rolling mill, causing the production line to stop. A reduced forward-moving force on the seamless pipe shell after pierce rolling also means an increased transportation time before hot rolling, and this causes a temperature drop of the seamless pipe shell.

Shape defects in the non-steady-state portions at the front and back ends of a seamless pipe shell occur most often during pierce rolling with a skew rolling mill. Pierce rolling takes advantage of the plastic deformation of a solid billet into a hollow blank with a bore. Because the volume remains constant during plastic deformation, the material that turns into a hollow pipe stretches both axially and circumferentially. In pierce rolling, the amount of axial and circumferential stretch is appropriately controlled by setting appropriate pierce rolling conditions or by disposing guides. This enables production of a seamless pipe shell having an appropriate wall thickness and an appropriate outside diameter. However, because the non-steady-state portions at the front and back ends of a seamless pipe shell are terminals with no continuity to any material on either side, the shape of these pipe portions is not as easily controllable as the steady-state portion.

The principle underlying pierce rolling using a skew rolling mill is another factor that makes shape control of front and back non-steady-state portions difficult. To illustrate, regardless of the form of the skew rolling mill, the relation gap 3>gap 1>gap 2 holds when gap 1 is the roll gap on the entry side where the rolls bite a solid billet in a pierce rolling mill, gap 2 is the roll gap in the rolling zone where the plug disposed between the rolls provides an appropriate wall thickness and an appropriate outside diameter with the rolling rolls, and gap 3 is the roll gap on the discharge side where the shell after pierce rolling is discharged from the machine.

To be more specific, the rolling zone is where the rolling rolls have the narrowest gap, and, because this is the area where the solid billet is pierced into a hollow seamless pipe shell, the amount of circumferential and axial deformation is largest in this part of rolling. Because of the nature of a skew rolling mill requiring a larger gap for gap 3 on the discharge side than for gap 2 of the rolling rolls at the rolling zone, the shape of the non-steady-state portions at the front and back ends of a seamless pipe shell, with large deformation occurring in the rolling zone, cannot be controlled as sufficiently as the steady-state portion. Shape defects in the non-steady portions at the front and back ends of a seamless pipe shell formed with a skew rolling mill have multiple causes, including the lubrication state of tools and the temperature distribution at the time, variation of material components, and heating temperature distribution. It is accordingly difficult to prevent shape defects in the non-steady-state portions at the front and back ends of a seamless pipe shell with the skew rolling mill alone or by varying the rolling conditions.

PTL 1 discloses a method that applies forward pressure to the back of a billet in pierce rolling. However, the method is intended for control on the entry side of the mill, and is not applicable to the discharge side of the mill. It might be possible to pull a seamless pipe shell from inside of a skew rolling mill with, for example, some kind of device designed to pull a seamless pipe shell that is stuck inside a skew rolling mill. However, it is still not possible to overcome the shape defects occurring in the back non-steady-state portion and causing discharge failure. That is, insertion failure of internal tool and protrusion can still occur in the hot rolling process even with such measures. The disclosed embodiments were made in view of such problems, and it is an object of the disclosed embodiments to provide a skew rolling apparatus capable of preventing shape defects that occur in non-steady-state portions at the front and back ends of a seamless pipe shell. The disclosed embodiments are also intended to provide a method for manufacturing a seamless pipe shell, and a method for manufacturing a seamless steel pipe using such a skew rolling apparatus.

Solution to Problem

A configuration that has solved the foregoing issues is summarized as follows.

[1] A skew rolling apparatus including:

a skew piercing mill for pierce rolling; and a skew outside-diameter mill following the skew piercing mill, the skew piercing mill having a plurality of pierce rolling rolls provided circumferentially around a pass line, a plug provided between the plurality of pierce rolling rolls, and a bar holding the plug, the skew outside-diameter mill having a plurality of outside-diameter rolling rolls provided circumferentially around the pass line, the skew rolling apparatus satisfying the following formulae (1) and (2), $$3\times(1.2PO+2G)\leq LS\leq 0.8BL \quad (1)$$

$$1.2PO+2G>DS\geq DB+2G \quad (2),$$

where LS is the distance (mm) between a rolling zone of the pierce rolling rolls and a rolling zone of the outside-diameter rolling rolls, DS is the roll gap between the plurality of outside-diameter rolling rolls, PO is the outside diameter (mm) of the plug, G is the gap (mm) between the plug and the pierce rolling rolls, BL is the length (mm) of the bar, and DB is the outside diameter (mm) of the bar.

[2] The skew rolling apparatus according to [1], wherein the skew piercing mill has three or more pierce rolling rolls.

[3] The skew rolling apparatus according to [1] or [2], wherein the skew outside-diameter mill has three or more outside-diameter rolling rolls.

[4] The skew rolling apparatus according to any one of [1] to [3], wherein the skew outside-diameter mill further includes a drive unit for varying the roll gap DS, and a sensor for detecting a position of a seamless pipe shell.

[5] The skew rolling apparatus according to any one of [1] to [4], wherein the skew outside-diameter mill further includes a drive unit for rotary driving the outside-diameter rolling rolls.

[6] A method for manufacturing a seamless pipe shell with the skew rolling apparatus of any one of [1] to [5], wherein the outside-diameter rolling rolls have a roll gap DS that is 84% to 99% of an outside diameter $dO_2$ of a steady-state portion of a seamless pipe shell after pierce rolling.

[7] A method for manufacturing a seamless pipe shell with the skew rolling apparatus of [5], wherein outside-diameter rolling by the skew outside-diameter mill is faster than pierce rolling by the skew pierce rolling mill.

[8] A method for manufacturing a seamless steel pipe, including:

pierce rolling of a steel material into a seamless pipe shell with the skew rolling apparatus of any one of [1] to [5]; and hot rolling the seamless pipe shell.

Advantageous Effects

A skew rolling apparatus of the disclosed embodiments can prevent shape defects that occur in non-steady-state portions at the front and back ends of a seamless pipe shell after pierce rolling. This makes it possible to prevent insertion failure of internal tool and protrusion in a hot rolling process, and improve the productivity and yield of a seamless steel pipe.

BRIEF DESCRIPTION OF THE DRAWINGS

FIG. 1 is a diagram illustrating a pierce rolling roll used for a skew piercing mill.

FIG. 2 is a schematic view representing an example of a shape defect occurring in non-steady-state portions at the front and back ends of a seamless pipe shell after pierce rolling.

FIG. 3 is a schematic view representing another example of a shape defect occurring in non-steady-state portions at the front and back ends of a seamless pipe shell after pierce rolling.

FIG. 4 is a schematic view representing an example of a skew rolling apparatus 10 according to an embodiment.

FIG. 5 is a diagram illustrating the roll gap DS of a skew outside-diameter rolling mill having two outside-diameter rolling rolls.

FIG. 6 is a diagram illustrating the roll gap DS of a skew outside-diameter mill having three outside-diameter rolling rolls.

DETAILED DESCRIPTION

An embodiment is described below with reference to the accompanying drawings. FIG. 1 is a diagram illustrating a pierce rolling roll used for a skew piercing mill. FIG. 1(*a*) illustrates the shape of a pierce rolling roll and a cross angle, as viewed from an angle where the pass line and the pierce rolling roll do not overlap each other. FIG. 1(*b*) illustrates the skew angle of the pierce rolling roll, as viewed from an angle where the pass line and the pierce rolling roll overlap each other. In the present embodiment, the rolling roll used for the skew piercing mill will be called a pierce rolling roll.

The pierce rolling roll used for the skew piercing mill is of a cone type, as shown in FIG. 1(*a*-1), or of a barrel type, as shown in FIG. 1(*a*-2). As shown in FIG. 1(*a*), the cone-type pierce rolling roll typically has a cross angle β with respect to the pass line. The pierce rolling roll shown in FIG. 1(*b*) is a barrel-type pierce rolling roll. Typically, the cone-type pierce rolling roll and the barrel-type pierce rolling roll have a skew angle α with respect to the pass line.

A rolling workpiece or a pierce-rolled seamless pipe shell moves forward along the pass line in the direction of arrow, according to the skew angle α and the rotational speed of the pierce rolling roll. The skew angle α and cross angle β are decided according to the form of skew piercing mill, or rolling conditions corresponding to the rolled workpiece. The number of pierce rolling rolls is decided according to the purpose of rolling. Typically, a pair of opposing rolls is provided across the pass line, together with a pair of guides orthogonal to these rolls, or at least two pierce rolling rolls are provided circumferentially around the pass line, without providing guides.

In the cone-type and barrel-type pierce rolling rolls shown in FIG. 1(*a*), the side of pierce rolling roll receiving a rolling workpiece is the entry side of the pierce rolling roll. The rolling zone is where rolling takes place between the pierce rolling rolls and a plug provided between the pierce rolling rolls. The discharge side is where a seamless pipe shell after pierce rolling is discharged. Regardless of the type of skew rolling mill, the pierce rolling rolls are disposed so that, on the entry side, the gap between the pierce rolling rolls is wider toward the entry side for biting of the rolled workpiece. The gap between the pierce rolling rolls is narrowest in the rolling zone, and a piercing plug is disposed near the pass line in the rolling zone. The gap between the pierce rolling rolls is wider toward the discharge side for discharge of the pierce-rolled seamless pipe shell from the skew piercing mill.

The following describes the steady-state portion and non-steady-state portion of a seamless pipe shell after pierce rolling. A seamless pipe shell formed by rolling in a pierce rolling mill has a steady-state portion and a non-steady-state portion. The steady-state portion is a middle portion of pipe where the shape remains stable. The non-steady-state portion occurs at the front and back ends of pipe, and the shape is unstable in non-steady-state portions.

FIG. 2 is a schematic view representing an example of a shape defect occurring in non-steady-state portions at the front and back ends of a seamless pipe shell after pierce rolling. In FIG. 2, (a) is a front view, (b) is a top view, (c) is a left side view, and (d) is a right side view.

FIG. 2 shows a seamless pipe shell having ellipsoidal non-steady-state portions at the front and back ends of pipe. The non-steady-state portions at the front and back ends of pipe turn ellipsoidal primarily when pierce rolling is performed with two opposing pierce rolling rolls. Such ellipsoidal non-steady-state portions at the front and back ends of pipe occur when the extent of circumferential stretch in the rolling zone is greater at the front and back ends of pipe than in the steady-state portion, and are formed as the seamless pipe shell moves past the rolling zone and passes through the discharge side.

FIG. 3 is a schematic view representing another example of a shape defect occurring in non-steady-state portions at the front and back ends of a seamless pipe shell after pierce rolling. In FIG. 3, (a) is a front view, (b) is a top view, (c) is a left side view, and (d) is a right side view.

FIG. 3 shows a seamless pipe shell having triangular non-steady-state portions at the front and back ends of pipe. The non-steady-state portions at the front and back ends of pipe turn triangular primarily when pierce rolling is performed with three pierce rolling rolls. On the discharge side, the seamless pipe shell makes contact with the pierce rolling rolls at three points, leaving three non-contacting portions.

This makes triangular non-steady-state portions at the front and back ends of pipe. Because pierce rolling of a rolled workpiece rotates the workpiece in helical motion, the apices of the triangle in the front non-steady-state portion do not match the apices of the triangle in the back non-steady-state portion, and these shapes are often out of phase each other at the front and back ends. The shape defect in non-steady-state portions is usually more severe at the back end than the front end, regardless of the number of pierce rolling rolls.

In a skew piercing mill used for pierce rolling, it is not easy to eliminate the shape defect of non-steady-state portions at the front and back ends of pipe simply by varying the number and shape of pierce rolling rolls, or by changing the layout of pierce rolling rolls. As discussed above, shape defects in non-steady-state portions at the front and back ends of pipe cause trouble in inserting an internal tool in the next hot rolling process.

The following describes what causes such operation trouble. Here, the smallest inside diameter of the front non-steady-state portion is dT, the smallest inside diameter of the back non-steady-state portion is dB, and the diameter of an internal tool inserted into a seamless pipe shell in the hot rolling process is dN. The internal tool cannot be inserted into the seamless pipe shell in the hot rolling process when the smallest inside diameter dT of the front non-steady portion and the smallest inside diameter dB of the back non-steady portion are smaller than the internal tool diameter dN. To prevent such operation trouble, it is preferable to control the smallest inside diameters dT and dB of the non-steady portions so as to satisfy $dN \leq dT$ and $dN \leq dB$.

When dT and dB are too large compared to the inside diameter $dO_1$ of the steady-state portion, other troubles such as protrusion between rolling rolls or guides can occur in the next hot rolling process, even when $dN \leq dT$ and $dN \leq dB$ are satisfied. It is therefore more preferable to control the smallest inside diameters dT and dB of the front and back non-steady-state portions so as to satisfy $1.2dO_1 \geq dT$ and $1.2dO_1 \geq dB$, in addition to satisfying $dN \leq dT$ and $dN \leq dB$.

The inner circumference lengths of the front and back non-steady-state portions do not become overly smaller than the inner circumference length of the steady-state portion. Accordingly, the smallest inside diameters dT and dB of the non-steady-state portions should satisfy $dN \leq dT$ and $dN \leq dB$, and $1.2dO_1 \geq dT$ and $1.2dO_1 \geq dB$ when the front and back non-steady-state portions are corrected to a shape close to the true circular shape of the steady-state portion.

FIG. 4 is a schematic view representing an example of a skew rolling apparatus 10 according to the disclosed embodiments. In FIG. 4, only the rolled workpiece 40 is shown in a cross section to indicate the position of a plug 26. In order to correct the front and back non-steady-state portions to a shape close to the true circular shape of the steady-state portion, the skew rolling apparatus 10 of the present embodiment includes a skew outside-diameter mill 30, following a skew pierce rolling mill 20 used for pierce rolling.

The skew piercing mill 20 is a rolling mill for pierce rolling of a rolled workpiece 40 made of steel material. The skew piercing mill 20 includes a pair of opposing pierce rolling rolls 22 and 24 equally distanced apart from a pass line 50, a plug 26 provided between the pierce rolling rolls 22 and 24, a bar 28 holding the plug 26, and a drive unit (not shown) for driving the pierce rolling rolls 22 and 24. In the example shown in FIG. 4, the skew piercing mill 20 has a pair of opposing pierce rolling rolls 22 and 24 equally distanced apart from the pass line 50. However, in some embodiments, the skew piering mill 20 may have three or more pierce rolling rolls provided circumferentially around the pass line 50. With three pierce rolling rolls, the skew piercing mill 20 can provide an inner surface of improved quality for the pierce-rolled seamless pipe shell compared to when two pierce rolling rolls are provided. Providing three pierce rolling rolls also enables more stable pierce rolling, and can also improve the quality of outer surface because the outer surface of rolled workpiece 40 can be supported at three points during pierce rolling. The same effect can be obtained when at least three pierce rolling rolls are provided, and more than three pierce rolling rolls may be provided. However, because increasing the number of pierce rolling rolls necessitates reducing the roll diameter, the accompanying decrease of roll shaft diameter leads to decrease of load bearing capacity. It is therefore preferable that the number of pierce rolling rolls in the skew piercing mill be 3 or 4.

The skew outside-diameter mill 30 has a pair of opposing outside-diameter rolling rolls 32 and 34, equally distanced apart from the pass line 50. The skew piercing mill 20 and the skew outside-diameter mill 30 are provided so that the distance LS (mm) between the rolling zone of the pierce rolling rolls 22 and 24 and the rolling zone of the outside-diameter rolling rolls 32 and 34 satisfies the formula (3) below. The outside-diameter rolling rolls 32 and 34 are provided so that the roll gap DS (mm) in the rolling zone of the outside-diameter rolling rolls 32 and 34 satisfies the formula (4) below.

$$3dO_2 \leq LS \leq 0.8LH \tag{3}$$

$$dO_2 > DS \geq dO_2 - (dO_2 - DB - 2t) \tag{4}$$

In the formulae (3) and (4), $dO_2$ is the outside diameter (mm) in the steady portion of a seamless pipe shell obtained by pierce rolling with the skew piercing mill 20, LH is the length (mm) of a seamless pipe shell after pierce rolling, DB is the diameter (mm) of bar 28, and t is the wall thickness (mm) of a seamless pipe shell after pierce rolling. Here, $dO_2$, LH, and t represent dimensions of a seamless pipe shell after the pierce rolling of a rolled workpiece 40 with the skew piercing mill 20 of the skew rolling apparatus 10, before outside-diameter rolling with the skew outside-diameter mill 30.

In the example shown in FIG. 4, the skew outside-diameter mill 30 has a pair of opposing outside-diameter rolling rolls 32 and 34 equally distanced apart from the pass line 50. However, in some embodiments, the skew outside-diameter mill 30 may have three or more outside-diameter rolling rolls provided circumferentially around the pass line 50. A skew outside-diameter mill 30 having three outside-diameter rollingrolls enables more stable outside-diameter rolling, and can improve the quality of outer surface because the outer surface of the seamless pipe shell can be supported at three points during outside-diameter rolling. With three outside-diameter rolling rolls, the seamless pipe shell can more easily deform under circumferential compression, and this improves the effectiveness of the correction of the front and back non-steady portions. The same effect can be provided when at least three outside-diameter rolling rolls are provided, and more than three outside-diameter rolling rolls may be provided. However, because increasing the number of outside-diameter rolling rolls necessitates reducing the roll diameter, the accompanying decrease of roll shaft diameter leads to decrease of load bearing capacity. It is therefore preferable that the number of outside-diameter rolling rolls in the skew outside-diameter mill be 3 or 4.

The rolling zone of pierce rolling rolls 22 and 24 is where the roll gap between pierce rolling rolls 22 and 24 along a direction perpendicular to the pass line 50 is narrowest. Similarly, the rolling zone of outside-diameter rolling rolls 32 and 34 is where the roll gap between outside-diameter rolling rolls 32 and 34 is narrowest.

FIG. 5 is a diagram illustrating the roll gap DS of a skew outside-diameter mill having two outside-diameter rolling rolls 36. FIG. 5(*a*) is a front view, and FIG. 5(*b*) is a side view. As shown in FIG. 5(*b*), when two outside-diameter rolling rolls 36 are provided, the roll gap DS between the outside-diameter rolling rolls 36 is the shortest distance between the rolls in an area (rolling zone) where the outside-diameter rolling rolls 36 have the narrowest gap.

FIG. 6 is a diagram illustrating the roll gap DS of a skew outside-diameter mill having three outside-diameter rolling rolls 36. FIG. 6(*a*) is a front view, and FIG. 6(*b*) is a side view. FIG. 6(*c*) shows an enlarged view of portion A of FIG. 6(*b*). FIG. 6(*a*) shows only two of the three outside-diameter rolling rolls 36 to more clearly illustrate the relationship between rolled workpiece 40 and outside-diameter rolling rolls 36. As shown in FIG. 6(*c*), when three outside-diameter rolling rolls 36 are provided, the roll gap DS between the outside-diameter rolling rolls 36 is the diameter of a circle contacting the outside-diameter rolling rolls 36 in an area (rolling zone) where the outside-diameter rolling rolls 36 have the narrowest gap. This is the same for the roll gap DS of when four or more outside-diameter rolling rolls 36 are provided.

Shape defects in non-steady-state portions occur as the rolled workpiece passes through the pierce rolling rolls 22 and 24 that are increasingly wider from the rolling zone toward the discharge side. From this observation, the inventors thought of providing outside-diameter rolling rolls 32 and 34 to correct the shape of front and back non-steady-state portions in the rolling zone of the outside-diameter rolling rolls 32 and 34. To describe more specifically, pierce rolling in the rolling zone of the skew piercing mill 20 inevitably involves large circumferential stretch and deformation that causes shape defects in the front and back non-steady-state portions of the shell during pierce rolling. This led to the idea of compressing and deforming the seamless pipe shell to reduce the outside diameter in the rolling zone of the skew outside-diameter mill 30 following pierce rolling, in order to correct the shape defect and provide a desirable shape for the front and back non-steady-state portions.

Compressive deformation that reduces the outside diameter of the seamless pipe shell in the rolling zone of the skew outside-diameter mill 30 can be achieved by disposing the outside-diameter rolling rolls 32 and 34 in such a way that the roll gap DS between the outside-diameter rolling rolls 32 and 34 satisfies the formula (4) above. By satisfying formula (4), the roll gap DS between the outside-diameter rolling rolls 32 and 34 of the skew outside-diameter mill 30 is less than the outside diameter $dO_2$ of the steady-state portion of the seamless pipe shell after pierce rolling, and is no smaller than the outside diameter calculated by subtracting ($dO_2$−DB−2t) from the outside diameter $dO_2$ of the steady-state portion of the seamless pipe shell, where ($dO_2$−DB−2t) represents the clearance between the inside diameter $dO_1$ of the pierce-rolled seamless pipe shell, and the bar 28 penetrating the pipe. That is, formula (4) defines the condition that there is no wall thickness reduction in the rolling zone of the skew outside-diameter mill 30, and the condition that the outside diameter of the front and back non-steady-state portions is reduced to less than the outside diameter $dO_2$ of the steady-state portion of the seamless pipe shell.

As discussed above, shape defects in front and back non-steady-state portions occur as a result of circumferential stretch of a seamless pipe shell in the rolling zone of the pierce rolling rolls 22 and 24. By satisfying the formula (4), the outer diameter can be reduced without reduction of wall thickness in the rolling zone of the outside-diameter rolling rolls, and the shape of the front and back non-steady-state portions can be appropriately corrected. In order to effectively correct the shape of the front and back non-steady portions, it is preferable that the roll gap DS between the outside-diameter rolling rolls 32 and 34 be 84% to 99% of $dO_2$. With the roll gap DS confined in this range, it is also possible to improve circumferential variation that has occurred in the wall thickness of the seamless pipe shell during pierce rolling.

After outside-diameter rolling, the shell has an increased wall thickness that depends on the rolling reduction of outside diameter (percentage reduction of diameter). The extent of increase of wall thickness after outside-diameter rolling increases when the roll gap DS between the outside-diameter rolling rolls is less than 84% of $dO_2$. This is not preferable because the amount of wall thickness that needs to be reduced in the rolling process following outside-diameter rolling is increased, and the load on equipment is increased. When the value of DB is decreased to satisfy formula (4), the rigidity of the bar decreases, and the bar has an increased risk of being damaged during rolling. It is therefore preferable that the roll gap DS between the outside-diameter rolling rolls be at least 84% of $dO_2$. In view of restraining increase of wall thickness after outside-diameter rolling and preventing damage to the bar, the roll gap DS between the outside-diameter rolling rolls is preferably at least 90% of doz.

It is not preferable to make the roll gap DS of the outside-diameter rolling rolls more than 99% of $dO_2$ because, in this case, the rolling reduction of outside diameter decreases, and the predetermined correction effect cannot be obtained. Decrease of rolling reduction of outside diameter is caused by less friction as the pipe fails to securely contact the outside-diameter rolling rolls. This causes scratches due to the difference between the circumferential velocity of the rolls and the rotational speed at the outer surface of pipe. Another reason that decrease of rolling reduction of outside diameter is not preferable is that the outside-diameter rolling mill fails to transmit its power when driving the pipe. For these reasons, the roll gap DS between the outside-diameter rolling rolls is preferably at most 99% of $dO_2$, more preferably at most 95% of $dO_2$.

It is required in the skew rolling apparatus 10 according to the present embodiment that the distance LS between the rolling zone of the pierce rolling rolls 22 and 24 and the rolling zone of the outside-diameter rolling rolls satisfy the formula (3) above. This will be described below with reference to FIG. 4.

Formula (3) defines the condition that the distance LS between the rolling zone of the pierce rolling rolls 22 and 24 and the rolling zone of the outside-diameter rolling rolls 32 and 34 is at most 0.8 times the length LH of a seamless pipe shell after pierce rolling, and at least 3 times the outside diameter $dO_2$ of the steady-state portion of a seamless pipe shell after pierce rolling.

The distance LS between the rolling zone of the pierce rolling rolls 22 and 24 and the rolling zone of the outside-diameter rolling rolls 32 and 34 is at most 0.8 times the length LH of a seamless pipe shell after pierce rolling. This is for the following reasons. The non-steady-state portion at the front end of a seamless pipe shell falls within 20% of the length LH of the seamless pipe shell produced.

Accordingly, LS is confined within 80% of LH when correcting the shape of the front non-steady-state portion. In this way, the skew outside-diameter mill 30 can achieve outside-diameter rolling of the front non-steady-state portion using the helical rotation of the seamless pipe shell formed by pierce rolling with the skew piercing mill 20, without having to provide a drive unit for rotating the outside-diameter rolling rolls 32 and 34 in the skew outside-diameter mill 30. The outside-diameter rolling of the front non-steady-state portion by the skew outside-diameter mill 30 enables correction of shape defects in the front non-steady-state portion.

In principle, the distance between the rolling zone of the pierce rolling rolls 22 and 24 and the rolling zone of the outside-diameter rolling rolls 32 and 34 cannot be brought to zero because these mills would interfere with each other. The skew pierce rolling mill 20 used for pierce rolling increases its size with increasing outside diameters $dO_2$ of the steady portion of the seamless pipe shell to be rolled. The extent of interference between the mills depends on the size of the skew pierce rolling mill 20 and the size of the skew outside-diameter mill 30. It can be said that the size related to the interference between the skew piercing mill 20 and the skew outside-diameter mill 30 is proportional to the outside diameter $dO_2$ of the steady-state portion of the seamless pipe shell formed by the skew piercing mill 20 used for pierce rolling. It follows from this that the distance between the rolling zone of the pierce rolling rolls 22 and 24 and the rolling zone of the outside-diameter rolling rolls 32 and 34 should also be governed by the outside diameter $dO_2$ of the steady-state portion of the seamless pipe shell after pierce rolling. That is, in order to stably perform pierce rolling and outside-diameter rolling with no interference between the skew piercing mill 20 and the skew outside-diameter mill 30, it is important that the distance LS between the rolling zone of the pierce rolling rolls 22 and 24 and the rolling zone of the outside-diameter rolling rolls 32 and 34 be at least $3 \times dO_2$.

As discussed above, the shape of the non-steady-state portions at the front and back ends of a seamless pipe shell after pierce rolling can be corrected, and a seamless steel pipe can be produced without trouble in the next hot rolling process when the distance LS between the rolling zone of the pierce rolling rolls 22 and 24 and the rolling zone of the outside-diameter rolling rolls 32 and 34 satisfies the formula (3), and when the roll gap DS between the outside-diameter rolling rolls 32 and 34 satisfies the formula (4).

The inside diameter $dO_1$ of the steady-state portion of the seamless pipe shell is larger than the largest outside diameter PO of the plug 26 used by the skew piercing mill 20. The inside diameter of the seamless pipe shell is 1.0 to 1.2 times larger than the largest outside diameter PO of the plug 26. Accordingly, the value of 1.2PO+2t is equal to the largest diameter $dO_2$ of the steady-state portion of the seamless pipe shell after pierce rolling. Pierce rolling forms the wall thickness of the shell by reducing the wall thickness between the plug 26 and the pierce rolling rolls 22 and 24. Accordingly, the smallest gap G between the plug 26 and the pierce rolling rolls 22 and 24 is equal to the wall thickness t of the seamless pipe shell formed.

When the length of the bar 28 holding the plug 26 is BL, BL is equal to the greatest value of the length LH of the seamless pipe shell after pierce rolling. These geometric relationships enable predictions of the outside diameter $dO_2$ of the steady portion of the seamless pipe shell after pierce rolling, and the wall thickness t of the seamless pipe shell. These predicted values can be used to represent formula (3) and formula (4) in the forms of the formula (1) and formula (2) below, respectively.

$$3 \times (1.2PO+2G) \leq LS \leq 0.8BL \quad (1)$$

$$1.2PO+2G > DS \geq DB+2G \quad (2)$$

In the formulae (1) and (2), PO is the outside diameter (mm) of plug 26, G is the gap (mm) between plug 26 and pierce rolling rolls 22 and 24, BL is the length (mm) of bar 28, and DB is the outside diameter (mm) of bar 28. The gap G between plug 26 and pierce rolling rolls 22 and 24 can be calculated by subtracting the outside diameter PO of plug 26 from the roll gap DS of outside-diameter rolling rolls 32 and 34, and dividing the calculated value by 2.

As with the case of formulae (3) and (4), the shape of the non-steady-state portions at the front and back ends of the seamless pipe shell after pierce rolling can be corrected, and a seamless steel pipe can be produced without trouble in the next hot rolling process when the distance LS between the rolling zone of the pierce rolling rolls 22 and 24 and the rolling zone of the outside-diameter rolling rolls 32 and 34 satisfies the formula (1), and when the roll gap DS between the outside-diameter rolling rolls 32 and 34 satisfies the formula (2).

In skew pierce rolling mill 20, shape defects in the front and back non-steady-state portions occur irrespective of how the pierce rolling rolls 22 and 24 are shaped or how many pierce rolling rolls 22 and 24 are provided. Accordingly, the pierce rolling rolls 22 and 24 can be used regardless of the form of the skew piercing mill 20. The skew outside-diameter mill 30 for outside-diameter rolling requires at least two outside-diameter rolling rolls to enable outside-diameter rolling of a seamless pipe shell after pierce rolling. The outside-diameter rolling rolls used for skew outside-diameter mill 30 may be barrel-type rolls or cone-type rolls. The outside-diameter rolling rolls can adopt various layouts, provided that the roll gap DS between outside-diameter rolling rolls satisfies the foregoing formula (2). Other parameters of the layout of outside-diameter rolling rolls include skew angle $\alpha$ (see FIG. 1) and cross angle $\beta$. For skew angle $\alpha$, it is preferable that the skew angle $\alpha_2$ (°) of outside-diameter rolling rolls satisfy the following formula (5), where $\alpha_1$ (°) is the skew angle of pierce rolling rolls.

$$\alpha_1 > \alpha_2 \quad (5)$$

The non-steady-state portions at the front and back ends of pipe can be corrected even more effectively when the skew angle $\alpha_1$ of pierce rolling rolls and the skew angle $\alpha_2$ of outside-diameter rolling rolls satisfy the formula (5). Preferably, the cross angle $\beta_2$ of outside-diameter rolling rolls has a negative value (the direction of skew is opposite the direction of skew of angle $\beta_1$ with respect to the pass line) when the cross angle $\beta_1$ of pierce rolling rolls has a positive value. This makes it possible to increase the circumferential compressive force on the seamless pipe shell, and more effectively correct the front and back non-steady-state portions. It is to be noted, however, that $\beta_1$ and $\beta_2$ are confined within a range of preferably from −25° to 25° because the pierce rolling rolls and outside-diameter rolling rolls cannot be easily attached to the rotational shafts when $\beta_1$ and $\beta_2$ are overly large.

The skew outside-diameter mill 30 may include a drive unit for varying the roll gap DS of outside-diameter rolling rolls 32 and 34, and a sensor for detecting a position of a seamless pipe shell. In some embodiments, the roll gap DS between outside-diameter rolling rolls 32 and 34 may remain the same as the diameter DB of the bar 28 of the skew piercing mill 20 until the distance between the pierce-frolled seamless pipe shell and the outside-diameter rolling rolls 32 and 34 reaches the set distance, and the drive unit may bring the roll gap DS between outside-diameter rolling rolls 32 and 34 to a roll gap DS satisfying the formula (2) upon the sensor detecting that the distance between the seamless pipe shell and the outside-diameter rolling rolls 32 and 34 is equal to or less than the set distance. In this way, the outside-diameter rolling rolls 32 and 34 are able to restrain vibrations occurring in the bar 28 holding the plug 26 during pierce rolling. This makes it possible to produce a product with improved dimensional accuracy and improved production stability.

The skew piercing mill 20 rotates a seamless pipe shell in a helical fashion. As such, the skew outside-diameter mill 30 is not necessarily required to be provided with a drive unit for driving and rotating the outside-diameter rolling rolls 32 and 34. Shape defects in the front non-steady-state portion can be corrected by the rotation of the skew piercing mill 20, provided that the distance LS between the rolling zone of the pierce rolling rolls and the rolling zone of the outside-diameter rolling rolls satisfies the formula (1) above.

The skew outside-diameter mill 30 may include a drive unit for rotary driving the outside-diameter rolling rolls 32 and 34. The following effects (1) to (3) can be obtained by providing a drive unit for rotary driving the outside-diameter rolling rolls 32 and 34.

(1) In case where the seamless pipe shell fails to be discharged from the discharge side of the skew piercing mill 20 because of shape defects occurring in the non-steady-state portion at the back end of pipe, the seamless pipe shell can be pulled out by driving the outside-diameter rolling rolls 32 and 34 of the skew outside-diameter mill 30. In this way, discharge failure of the seamless pipe shell at the discharge side of pierce rolling rolls 22 and 24 can be restrained.

(2) Rotary driving the outside-diameter rolling rolls 32 and 34 enables outside-diameter rolling of the non-steady-state portion at the back end of pipe, in the same way as for the front non-steady-state portion. This makes it possible to correct shape defects in the back non-steady-state portion of pipe.

(3) In skew piercing mill 20, pierce rolling may accidentally stop on the entry side or in the rolling zone during the pierce rolling process (before the round billet is completely bored). Such trouble in pierce rolling can be restrained by rotary driving the outside-diameter rolling rolls 32 and 34, with the provision that the front end of seamless pipe shell has reached the outside-diameter rolling rolls 32 and 34.

In a skew outside-diameter mill 30 having a drive unit, it is preferable that the roll circumferential velocity $V_1$ (m/min) of pierce rolling rolls 22 and 24, and the roll circumferential velocity $V_2$ (m/min) of outside-diameter rolling rolls 32 and 34 satisfy the following formula (6).

$$V_1 \leq V_2 \tag{6}$$

Pierce rolling and outside-diameter rolling can proceed in a stable fashion when $V_1$ and $V_2$ satisfy the formula (6), that is, when the outside-diameter rolling by skew outside-diameter mill 30 is faster than the pierce rolling by skew piercing mill 20. When $V_1 > V_2$, the seamless pipe shell after pierce rolling has a possibility of being strongly pushed toward the outside-diameter rolling rolls 32 and 34. This is not preferable as it may cause damage in the equipment. Because the roll circumferential velocity $V_2$ is the circumferential velocity of outside-diameter rolling rolls, two or more outside-diameter rolling rolls used for the skew outside-diameter mill 30 may have different roll diameters, provided that the outside-diameter rolling rolls have the same surface shape and the same circumferential velocity $V_2$. However, when rolls with greatly different outside diameters are used, the amount of deflection, occurring under perpendicularly applied load in a manner that depends on the shaft thickness of the roll, becomes different for these rolls. This is not preferable because it leads to decrease of dimensional accuracy of the pipe after outside-diameter rolling, and decrease of accuracy in setting DS. When using outside-diameter rolling rolls of different roll diameters, it is therefore preferable that the roll diameter be at least 50% of the largest outside-diameter rolling roll diameter, more preferably at least 80% of the largest outside-diameter rolling roll diameter. Preferably, the roll circumferential velocity of each outside-diameter rolling roll is less than +10% of the average roll circumferential velocity. In this way, warping of pipe after outside-diameter rolling can be restrained. When outside-diameter rolling is performed in a predetermined fashion, the roll circumferential velocity of the outside-diameter rolling rolls approaches the rotational speed at the outer surface of pipe because of the friction between the pipe and the rolls. Accordingly, it is not necessarily required to drive all the outside-diameter rolling rolls, and at least one of the outside-diameter rolling rolls may be driven when driving the outside-diameter rolling rolls to confine $V_2$ within the preferred range.

For insertion of an internal tool into the pierce-rolled seamless pipe shell fed to the following hot rolling process, the smallest inside diameter of the seamless pipe shell on the tool insertion side must be the same or greater than the diameter of the internal tool to be inserted into the pipe. The diameter of the internal tool inserted into the seamless pipe shell is decided according to the inside diameter $dO_1$ of the steady-state portion. That is, the smallest inside diameters dT and dB of a seamless pipe shell are controlled according to the inside diameter $dO_1$ of the steady-state portion.

The non-steady-state portions at the front and back ends of pipe protrude between the outside-diameter rolling rolls when the inside diameters of the front and back non-steady-state portions after correction by the skew outside-diameter mill 30 are overly large compared to the inside diameter of the steady-state portion. Because this causes trouble, it is preferable that the inside diameters of the front and back non-steady-state portions after the correction by the skew outside-diameter mill 30 be also determined according to the inside diameter $dO_1$ of the steady-state portion. Concerning the inside diameters of the front and back non-steady-state portions based on the inside diameter $dO_1$ of the steady-state portion, an examination was conducted from the perspective of improving the operation stability of the pierce rolling and hot rolling processes. It was found that the operation stability of pierce rolling and hot rolling can improve when the inside diameters of the front and back non-steady-state portions after correction fall in a range of preferably $0.9 \times dO_1$ or more and $1.1 \times dO_1$ or less. More preferably, the inside diameters of the front and back non-steady-state portions fall in a range of $0.95 \times dO_1$ or more and $1.05 \times dO_1$ or less. In this way, the operation stability of the pierce rolling and hot rolling processes can further improve.

The rolling material used for the production of a seamless pipe shell with the skew rolling apparatus 10 according to the present embodiment may be any material, provided that it can be used for pierce rolling. Likewise, the pierce rolling temperature may be any temperature, provided that it is a temperature applicable to pierce rolling.

Examples

The following describes Examples. Seamless pipe shells were produced using a skew rolling apparatus provided with a skew piercing mill having two or three pierce rolling rolls, and a skew outside-diameter mill having two or three outside-diameter rolling rolls. A carbon steel round billet measuring 150 mm in outside diameter and 2, 500 mm in length was used as a rolled material. Seamless pipe shells of Comparative Examples were produced simply by pierce rolling the rolled material after heating to 1,200° C. In Present Examples, the rolled material was heated to 1, 200° C., and subjected to pierce rolling and the following outside-diameter rolling process to produce seamless pipe shells.

The seamless pipe shells of Comparative Examples produced by pierce rolling without outside-diameter rolling were checked for the shape of non-steady-state portions at the front and back ends of pipe. The seamless pipe shells were produced using a pierce rolling mill having two or three pierce rolling rolls under the pierce rolling conditions adjusted to produce the same shape for the steady-state portion and for the non-steady-state portion with good reproducibility. The seamless pipe shells produced had a steady-state portion with an outside diameter of 180 mm, a wall thickness of 11 mm, and a length of 7, 656 mm. The bar used to hold the plug had a diameter of 128 mm. The pierce rolling rolls are cone-type pierce rolling rolls, and were used with a skew angle of 9°, and a cross angle of 20°. The seamless pipe shells produced were measured for the inside diameter of the steady-state portion, and the smallest inside diameters of the front and back non-steady-state portions. The ratio of the smallest inside diameter of the non-steady-state portion with respect to the inside diameter of the steady-state portion was then calculated for both the front and the back non-steady-state portion.

Subsequently, seamless pipe shells after the pierce rolling performed without changing the pierce rolling conditions were subjected to outside-diameter rolling using the skew outside-diameter mill. The seamless pipe shells produced were measured for the inside diameter of the steady-state portion, and the smallest inside diameters of the front and back non-steady-state portions. The ratio of the smallest inside diameter of the non-steady-state portion with respect to the inside diameter of the steady-state portion was then calculated for both the front and the back non-steady-state portion. Table 1 shows the outside diameter PO of the plug of the pierce rolling mill, the gap G between the plug and the pierce rolling rolls, the outside diameter DB of bar, and the bar length BL. The clearance value shown in Table 1 is a value obtained by subtracting the outside diameter DB of bar from the inside diameter $dO_1$ of the seamless pipe shell rolled by the pierce rolling mill. Table 2 shows the number of rolls in the skew pierce rolling mill, the number of rolls in the skew outside-diameter mill, the roll gap DS between outside-diameter rolling rolls, the skew angle of outside-diameter rolling rolls, the cross angle of outside-diameter rolling rolls, the distance LS between the rolling zone of the pierce rolling rolls and the rolling zone of the outside-diameter rolling rolls, the presence or absence of a drive unit for driving and rotating the outside-diameter rolling rolls, the circumferential velocity ratio ($V_2/V_1$), evaluation results for 1.2PO+2G>DS≥DB+2G, and values of $DS/dO_2 \times 100$. In Table 2, the open circle "○" in the column under "1.2PO+2G>DS≥DB+2G" means that 1.2PO+2G>DS≥DB+2G is satisfied, and "x" means that 1.2PO+2G>DS≥DB+2G is not satisfied. The seamless pipe shells of Present Examples all satisfied 3×(1.2PO+2G)≤LS≤0.8BL, though not shown in Table 2.

The formula $(DS/dO_2)\times 100$ represents the proportion (%) of the roll gap DS of outside-diameter rolling rolls relative to the outside diameter $dO_2$ of the steady-state portion of the seamless pipe shell after pierce rolling. In Examples, the roll gap DS of outside-diameter rolling rolls was controlled so that the roll gap DS was 82% to 99% of $dO_2$ (180 mm) in Comparative Examples (No. 1 to No. 4), and 84% to 99% of $dO_2$ in Present Examples (No. 5 to No. 19). Table 3 shows the ratios of the smallest inside diameters of the front and back non-steady-state portions with respect to the inside diameter of the steady-state portion calculated for Comparative Examples (No. 1 to No. 4) and Present Examples (No. 5 to No. 19).

TABLE 1

| PO (mm) | G (mm) | DB (mm) | Clearance (mm) | BL (m) |
|---|---|---|---|---|
| 131.5 | 11.0 | 128.0 | 29.8 | 9.0 |

TABLE 2

| No. | Number of rolls in pierce rolling | Number of rolls in outside-diameter rolling | DS (mm) | Skew angle (°) | Cross angle (°) | LS (mm) | Presence or absence of driving, Circumferential velocity ratio ($V_2/V_1$) (—) | 1.2PO + 2G > DS ≥ DB + 2G Satisfied or unsatisfied | $(DS/dO_2) \times 100$ (%) | |
|---|---|---|---|---|---|---|---|---|---|---|
| 1 | 2 | 2 | 149 | 3 | −10 | 850 | Present, (1.1) | × | 82.9 | Comparative Example |
| 2 | 3 | 2 | 149 | 3 | −10 | 850 | Present, (1.1) | × | 82.9 | Comparative Example |
| 3 | 2 | 3 | 149 | 3 | −10 | 550 | Present, (1.1) | × | 82.9 | Comparative Example |
| 4 | 3 | 3 | 149 | 3 | −10 | 7000 | Present, (1.1) | × | 82.9 | Comparative Example |
| 5 | 2 | 2 | 151 | 3 | −10 | 550 | Present, (1.1) | ○ | 84.0 | Example |
| 6 | 3 | 2 | 151 | 3 | −10 | 850 | Present, (1.1) | ○ | 84.0 | Example |
| 7 | 2 | 3 | 151 | 3 | −10 | 550 | Present, (1.1) | ○ | 84.0 | Example |
| 8 | 3 | 3 | 151 | 3 | −10 | 850 | Present, (1.1) | ○ | 84.0 | Example |
| 9 | 2 | 2 | 170 | 3 | −10 | 1200 | Present, (1.1) | ○ | 94.5 | Example |
| 10 | 3 | 2 | 170 | 3 | −10 | 1200 | Present, (1.1) | ○ | 94.5 | Example |
| 11 | 2 | 3 | 170 | 3 | −10 | 550 | Present, (1.1) | ○ | 94.5 | Example |
| 12 | 3 | 3 | 170 | 3 | −10 | 550 | Present, (1.1) | ○ | 94.5 | Example |
| 13 | 2 | 2 | 178 | 3 | −10 | 1150 | Present, (1.1) | ○ | 99.0 | Example |
| 14 | 3 | 2 | 178 | 3 | −10 | 1150 | Present, (1.1) | ○ | 99.0 | Example |
| 15 | 2 | 3 | 178 | 3 | −10 | 1150 | Present, (1.1) | ○ | 99.0 | Example |
| 16 | 3 | 3 | 178 | 3 | −10 | 1150 | Present, (1.1) | ○ | 99.0 | Example |

TABLE 2-continued

| No. | Number of rolls in pierce rolling | Number of rolls in outside-diameter rolling | DS (mm) | Skew angle (°) | Cross angle (°) | LS (mm) | Presence or absence of driving, Circumferential velocity ratio ($V_2/V_1$) (—) | 1.2PO + 2G > DS ≥ DB + 2G Satisfied or unsatisfied | ($DS/dO_2$) × 100 (%) | |
|---|---|---|---|---|---|---|---|---|---|---|
| 17 | 3 | 3 | 170 | 8 | −10 | 1300 | Present, (1.1) | ○ | 94.5 | Example |
| 18 | 3 | 3 | 170 | 3 | −25 | 7000 | Present, (1.1) | ○ | 94.5 | Example |
| 19 | 3 | 3 | 170 | 3 | −10 | 850 | Present, (0.9) | ○ | 94.5 | Example |

TABLE 3

| No. | After pierce rolling: Smallest inside diameter of front non-steady-state portion/inside diameter of steady-state portion × 100 (%) | After pierce rolling: Smallest inside diameter of back non-steady-state portion/inside diameter of steady-state portion × 100 (%) | After outside-diameter rolling: Smallest inside diameter of front non-steady-state portion/inside diameter of steady-state portion × 100 (%) | After outside-diameter rolling: Smallest inside diameter of back non-steady-state portion/inside diameter of steady-state portion × 100 (%) | |
|---|---|---|---|---|---|
| 1 | 89.2 | 85.4 | 87.0 | 82.0 | Comparative Example |
| 2 | 88.6 | 81.0 | 86.3 | 80.7 | Comparative Example |
| 3 | 89.2 | 85.4 | 88.7 | 80.5 | Comparative Example |
| 4 | 88.6 | 81.0 | 88.1 | 80.5 | Comparative Example |
| 5 | 89.2 | 85.4 | 102.8 | 98.6 | Example |
| 6 | 88.6 | 81.0 | 103.5 | 104.2 | Example |
| 7 | 89.2 | 85.4 | 101.5 | 98.5 | Example |
| 8 | 88.6 | 81.0 | 102.3 | 103.8 | Example |
| 9 | 89.2 | 85.4 | 103.2 | 98.7 | Example |
| 10 | 88.6 | 81.0 | 104.4 | 104.4 | Example |
| 11 | 89.2 | 85.4 | 100.7 | 99.3 | Example |
| 12 | 88.6 | 81.0 | 101.3 | 102.0 | Example |
| 13 | 89.2 | 85.4 | 100.8 | 99.0 | Example |
| 14 | 88.6 | 81.0 | 101.0 | 101.5 | Example |
| 15 | 89.2 | 85.4 | 99.5 | 100.0 | Example |
| 16 | 88.6 | 81.0 | 100.3 | 100.6 | Example |
| 17 | 88.6 | 81.0 | 105.3 | 108.0 | Example |
| 18 | 88.6 | 81.0 | 101.0 | 101.3 | Example |
| 19 | 88.6 | 81.0 | 103.3 | 106.0 | Example |

As shown in Table 3, in Examples (No. 5 to No. 19), the smallest inside diameters of the front and back non-steady-state portions immediately after pierce rolling were smaller than the inside diameter of the steady-state portion by at least 10%. After outside-diameter rolling, the smallest inside diameters of the front and back non-steady-state portions were within 10% of the inside diameter of the steady-state portion. This enabled stable production of a seamless steel pipe in the subsequent hot rolling process in Examples (No. 5 to No. 19). In contrast, in Comparative Examples (No. 1 to No. 4) that did not satisfy formula (2), the smallest inside diameters of the front and back non-steady-state portions, even after outside-diameter rolling, were smaller than the inside diameter of the steady-state portion by at least 10%, and it was not possible to correct the shape of the front and back non-steady-state portions in a desirable fashion. The seamless pipe shells of Comparative Examples experienced insertion failure of an internal tool in the following hot rolling process, and the process stopped in some of the pipes.

The invention claimed is:

1. A skew rolling apparatus comprising:

a skew pierce rolling mill configured to pierce roll a steel material into a seamless pipe shell;

a skew outside-diameter mill following the skew piercing mill in a pass direction of the seamless pipe shell in the skew rolling apparatus, the skew piercing mill comprising a plurality of pierce rolling rolls provided circumferentially around a pass line, a plug provided between the plurality of piercing rolls, and a bar configured to hold the plug, the skew outside-diameter mill comprising a plurality of outside-diameter rolling rolls provided circumferentially around the pass line, the skew rolling apparatus satisfying the following formulae (1) and (2), $$3\times(1.2PO+2G)\leq LS\leq 0.8BL \quad (1)$$

$$1.2PO+2G>DS\geq DB+2G \quad (2),$$

where LS is a distance (mm) between a rolling zone of the pierce rolling rolls and a rolling zone of the outside-diameter rolling rolls, DS is a roll gap between the plurality of outside-diameter rolling rolls, PO is an outside diameter (mm) of the plug, G is a gap (mm) between the plug and the pierce rolling rolls, BL is a length (mm) of the bar, and DB is an outside diameter (mm) of the bar.

2. The skew rolling apparatus according to claim 1, wherein at least one of (i) the skew piercing mill has three or more pierce rolling rolls, and (ii) the skew outside-diameter mill has three or more outside-diameter rolling rolls.

3. The skew rolling apparatus according to claim 2, wherein the skew outside-diameter mill further comprises a drive unit configured to vary the roll gap DS, and a sensor configured to detect a position of the seamless pipe shell.

4. The skew rolling apparatus according to claim 3, wherein the skew outside-diameter mill further comprises a drive unit configured to rotary drive the outside-diameter rolling rolls.

5. The skew rolling apparatus according to claim 2, wherein the skew outside-diameter mill further comprises a drive unit configured to rotary drive the outside-diameter rolling rolls.

6. The skew rolling apparatus according to claim 1, wherein the skew outside-diameter mill further comprises a drive unit configured to vary the roll gap DS, and a sensor configured to detect a position of the seamless pipe shell.

7. The skew rolling apparatus according to claim 6, wherein the skew outside-diameter mill further comprises a drive unit configured to rotary drive the outside-diameter rolling rolls.

8. The skew rolling apparatus according to claim 1, wherein the skew outside-diameter mill further comprises a drive unit configured to rotary drive the outside-diameter rolling rolls.

9. A method for manufacturing a seamless pipe shell with the skew rolling apparatus of claim 1, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

10. A method for manufacturing a seamless pipe shell with the skew rolling apparatus of claim 8, the method comprising:

pierce rolling the steel material into the seamless pipe shell; and outside-diameter rolling the pierce rolled seamless pipe shell, wherein the outside-diameter rolling is faster than the pierce rolling.

11. A method for manufacturing a seamless steel pipe, the method comprising:

pierce rolling a steel material into a seamless pipe shell with the skew rolling apparatus of claim 1, and hot rolling the seamless pipe shell.

12. A method for manufacturing a seamless pipe shell with the skew rolling apparatus of claim 2, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

13. A method for manufacturing a seamless pipe shell with the skew rolling apparatus of claim 4, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

14. A method for manufacturing a seamless pipe shell with the skew rolling apparatus of claim 8, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

15. A method for manufacturing a seamless pipe shell with the skew rolling apparatus of claim 3, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

16. A method for manufacturing a seamless pipe shell with the skew rolling apparatus of claim 5, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

17. A method for manufacturing a seamless pipe shell with the skew rolling apparatus of claim 7, the method comprising pierce rolling the steel material into the seamless pipe shell, wherein the roll gap DS of the outside-diameter rolling rolls is 84% to 99% of an outside diameter $dO_2$ of a steady-state portion of the seamless pipe shell after the pierce rolling.

18. A method for manufacturing a seamless pipe shell with the skew rolling apparatus of claim 2, the method comprising:

pierce rolling the steel material into the seamless pipe shell; and outside-diameter rolling the pierce rolled seamless pipe shell, wherein the outside-diameter rolling is faster than the pierce rolling.

19. A method for manufacturing a seamless pipe shell with the skew rolling apparatus of claim 6, the method comprising:

pierce rolling the steel material into the seamless pipe shell; and outside-diameter rolling the pierce rolled seamless pipe shell, wherein the outside-diameter rolling is faster than the pierce rolling.

20. A method for manufacturing a seamless pipe shell with the skew rolling apparatus of claim 3, the method comprising:

pierce rolling the steel material into the seamless pipe shell; and outside-diameter rolling the pierce rolled seamless pipe shell, wherein the outside-diameter rolling is faster than the pierce rolling.

* * * * *